United States Patent [19]

Berti

[11] 3,939,573

[45] Feb. 24, 1976

[54] PROCESS FOR DRYING WOOD

[76] Inventor: Furio Berti, Viale Thovez 40 int. 32, Turin, Italy

[22] Filed: Oct. 31, 1974

[21] Appl. No.: 519,712

[52] U.S. Cl. ..... 34/26; 34/16.5; 34/30

[51] Int. Cl.[2] ..... F26B 3/00

[58] Field of Search ..... 34/13.4, 13.8, 16.5, 26, 34/30

[56] References Cited

UNITED STATES PATENTS

| | | | |
|---|---|---|---|
| 3,262,216 | 7/1966 | Dugger, Sr. | 34/26 |
| 3,335,499 | 8/1967 | Larsson | 34/13.8 |

*Primary Examiner*—John J. Camby

*Attorney, Agent, or Firm*—Sughrue, Rothwell, Mion, Zinn & Macpeak

[57] ABSTRACT

A process for kiln drying timber in which heated air is passed over the timber, subsequently cooled to dehumidify it, and then reheated and recirculated, wherein times are substantially shortened by separating the process into two stages, a first stage where the temperature of the air passing over the wood is held relatively low, that is between 20°C and 30°C, and a second stage in which the temperature is raised to between 34°C and 38°C, the changeover from the first stage to the second being effected when the moisture content of the wood being dried has fallen to between 16 and 25 percent.

10 Claims, 2 Drawing Figures

PROCESS FOR DRYING WOOD

BACKGROUND OF THE INVENTION

The present invention relates to a process for kiln drying wood. In known drying processes hot air is blown over sawn unseasoned timber in stacks, each piece separated from its neighbour by a small spacer strip, and the humid air leaving the stacks of timber is dehumidified, reheated and recycled over the timber. The time taken for drying is determined by the maximum temperature to which the wood can be subjected since cracking, warping and splitting occur if the air blown over the wood is too hot. Moreover, if the drying process is not properly performed other materials, such as resins, tannins and other constituents of the wood can be lost. These constituents of the timber are important in imparting to it its natural characteristics and resistance to deterioration by natural agents such as wind and water.

In contrast with known drying processes, the present invention seeks to provide a process in which, in addition to the extraction of moisture from the wood, there is also a stabilization of the wood; this results in improved conservation of the form of the pieces of wood subjected to the drying process, of the original fibrous and porous structure of the wood itself, and finally of the content of resin, tannin and other substances which contribute to the natural resistance of the wood to natural agents of deterioration.

With prior art processes and known equipment it often happens in practice that the equipment is underutilised because there is only enough wood of one kind to partly fill the available space, this results from the fact that known processes for drying hard woods require different conditions from the known processes for drying soft woods. Even though only partly loaded the equipment still takes the same time to complete the process. This is evidently uneconomic and irrational. With this invention it has been found that it is possible to treat at the same time both a quantity of hardwood and a quantity of softwood so that the plant may be completely loaded up to its total capacity with wood of various kinds (hard, soft, resinous and so on) and to obtain the desired drying effect in a time substantially less than that which would be required with prior art methods by the kind of wood which takes the longest time to dry.

OBJECTS OF THE INVENTION

One object of this invention is to dry wood whilst maintaining substantially unchanged its natural properties and resistance against atmospheric agents.

Another object of this invention is to provide a drying process in which various kinds of wood may be dried simultaneously and in various thicknesses without prejudice to their ultimate stabilization.

A further object of the invention is to provide a process for drying and stabilising wood of any type in a time which is substantially shorter than that which the same wood would have needed in a prior art process.

SUMMARY OF THE INVENTION

According to the present invention a process for seasoning wood by forced drying in which air is circulated around a closed circuit during which it is heated, passed in contact with the surfaces of the wood to be dried, dehumidified by cooling and then reheated to commence another circuit is modified by the improvement wherein the process includes a first stage in which the temperature of the air passing over the timber is maintained at between 20°C and 30°C until the moisture content of the wood has fallen to between 16percent and 25 percent, following which there is a second stage in which the temperature of the air passing over the wood is raised to between 34°C and 38°C and maintained within this range until the moisture content of the wood has fallen to a selected level at which drying is considered complete.

Preferably the temperature of the air in the first stage of the process is maintained at between 20°C and 30°C until the moisture content of the wood has fallen to between 18 percent and 20 percent.

The wood moisture content range of 16–25 percent can be referred to as the "point of fibre saturation" and has been found to be a critical stage in the reduction of wood moisture content, through which the wood must be dehydrated relatively slowly to prevent defects such as cracking, warping and splitting. In general, the point of fibre saturation will vary somewhat from wood to wood, but will be near 20 or 25 percent moisture content.

Advantageously the drying is ended when the moisture content of the wood has fallen to between 8 and 12 percent.

Various other features and advantages of the invention will become apparent from the following description with reference to the accompanying drawings, which is provided purely by way of non-restrictive example.

DESCRIPTION OF THE PREFERRED EMBODIMENTS

Figure 1:
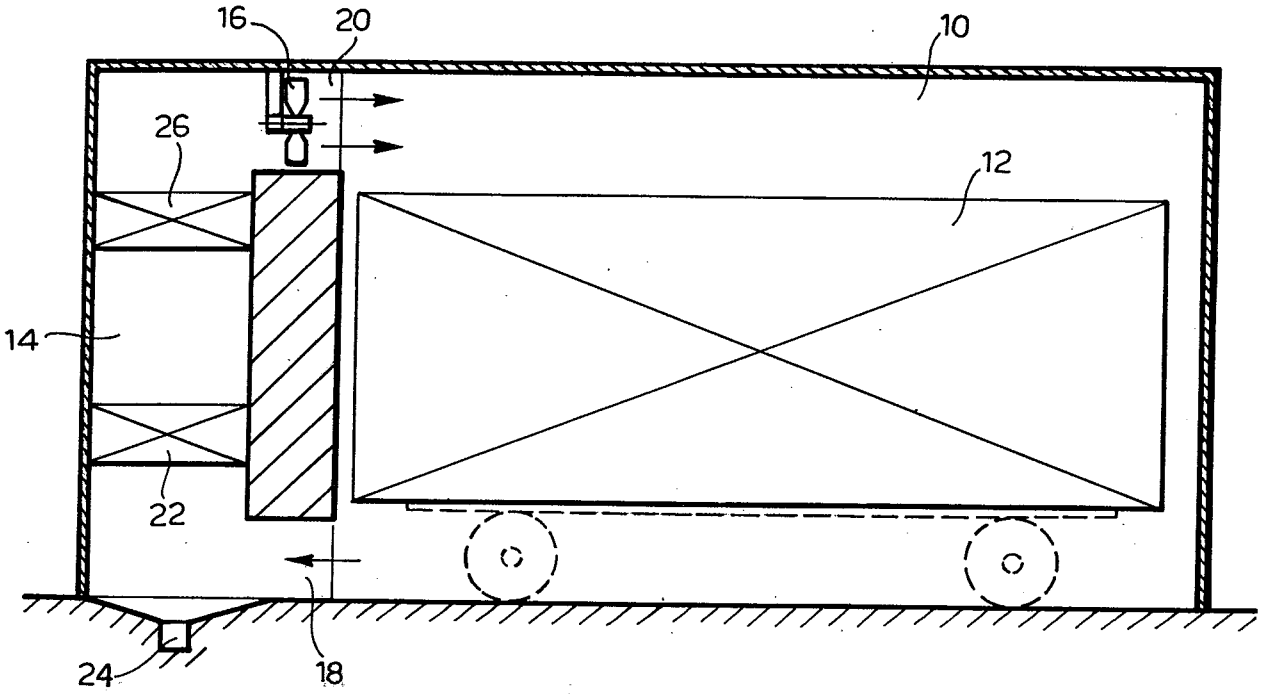
FIG. 1 is a diagrammatic section of a plant in which the process of the present invention can be performed.

In FIG. 1, 10 is a drying chamber containing a stack 12 of wood to be dried. Inside the chamber 10 the drying air gains moisture from the wood in the stack 12, it then passes through an opening 18 into an air conditioning section formed by a structure 14 at one end of the chamber 10. A fan 16 located at the top of the structure 14 provides for circulation of the air, drawing the humid air from the bottom of the chamber 10 through the opening 18 and blowing the reconditioned air through an inlet opening 20 into the chamber 10.

The air conditioning plant 14 includes a heat exchanger 22 for cooling the humid air drawn in from the chamber 10. On cooling of the air the excess moisture is condensed on the plates of the heat exchanger 22 and the condensate is discharged, for example, through a collecting channel 24. The air thus cooled and dehumidified is then heated by passing it through a heat exchanger 26 in the upper part of the structure 14; the heat exchanger 26 is maintained at a suitable high temperature such that the air blown by the fan 16 through the opening 20 into the chamber 10 has the requisite temperature in accordance with the teaching of this invention.

A more complete description of the plant (diagrammatically illustrated here only in its essentials in order to illustrate the process of this invention), is described in Italian Pat. No. 720,220 filed on Apr. 10, 1964 and issued on Nov. 2, 1966.

Figure 2:
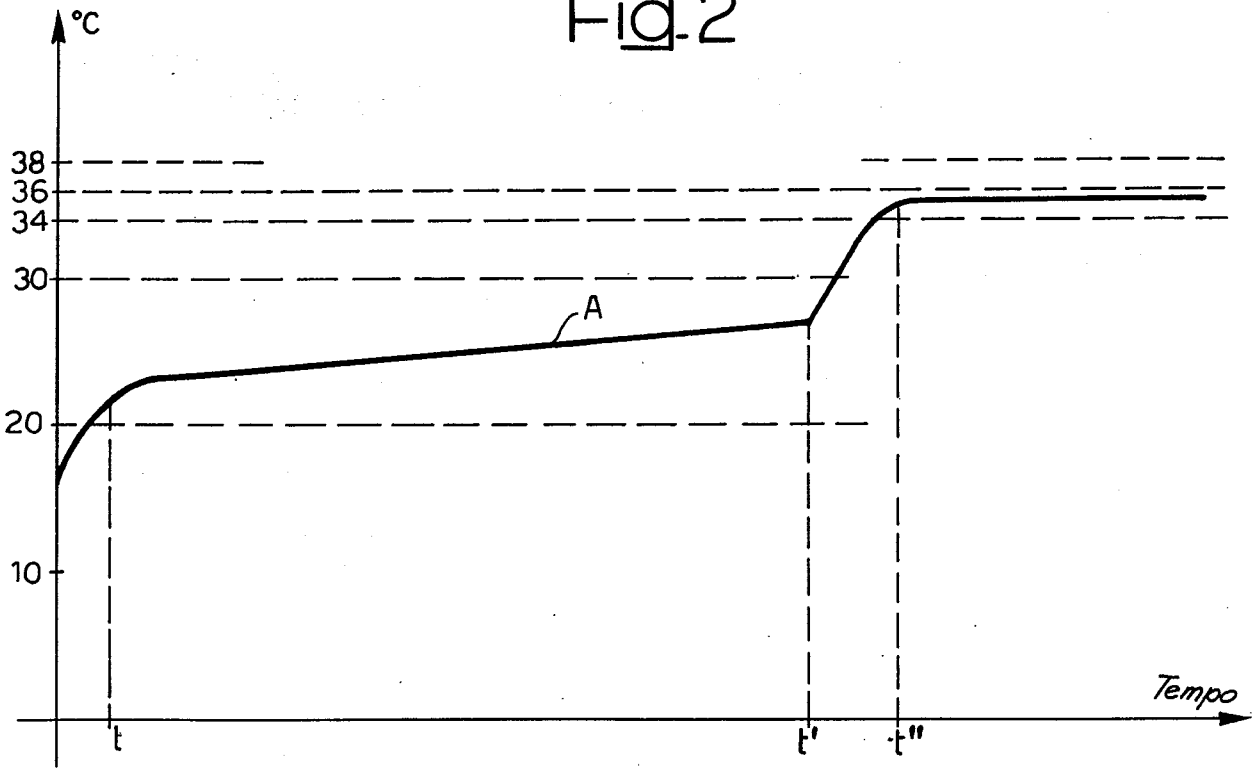
FIG. 2 is a diagram showing the variation of the temperature of the air flowing over the wood stack as a function of the drying time.

Referring now to FIG. 2, the curve A of the temperature is a curve drawn to typify the process of this invention. Usually wood to be dried has an initial temperature lower than 20°C. Therefore, once the wood is loaded into the chamber 10 of FIG. 1, the heater 26 will be switched on and the fan 16 operated for an initial time period *t* necessary to bring the wood 12 to a temperature between 20° and 30° C; the temperature of the wood may be determined, for example, by a thermometer positioned in the lower opening 18 through which air which has traversed the stack 12 passes on its way to the air conditioning plant 14. At time *t*, when the wood in the stack 12 has reached a temperature above the minimum value at which drying is to take place the heat exchanger 22 is turned on so as to commence dehumidifying the air, and the heater 26 is so regulated as to keep the temperature in the chamber 10 between the values 20°C and 30°C.

Under these conditions, with continuous dehumidification of the circulating air, the drying of the wood in the stack 12 commences. This sets up a humidity gradient within the thickness of each individual piece of the timber due to the removal of moisture from the outer layers by the warm dry air coming from the air conditioning plant 14. Eventually, under these conditions of temperature (20°C to 30°C) in the chamber 10, there will be no tendency for the pores of the wood to close so that the flow of moisture from the core of each piece of wood to the perimeter thereof encounters no obstacle whatever; this also has the effect that no deformations such as warping or splitting occur in the timbers. The progress of the drying in this stage of the process can be detected by any suitable means; there is available on the market apparatus suitably programmed for non-destructive tests (for instance the "AQUA BOY" apparatus made by the German firm K.P.M.) by means of which it is possible to determine at any time, the percentage by weight of the moisture contained in timber.

In conformity with this invention the first stage of the process is terminated when the moisture content of the wood in the stack 12 has dropped to between 16 and 25 percent (preferably to between 18and 20 percent by weight; the heater 26 is then adjusted so as to increase the temperature of the air and of the wood in the chamber 10 to a value between 34°C and 38°C, and preferably between 34°C and 36°C. The end of the first stage is shown at time *t'* in FIG. 2, in which it will be seen that the curve A rises sharply and re-establishes itself at a value between 34°C and 36°C. Again, in practice, this could be detected and controlled by means of a thermometer placed in the opening 18. The time taken from the *t'* until the temperature is stable at the new value (indicated *t''* in FIG. 2) depends obviously on the volume, the type and the variety of the timber in the stack 12, and on the volume of air in circulation; in practical cases it has been found that the time interval from *t'* to *t''* varies between 6 and 12 hours. Drying then proceeds under the new conditions established in accordance with stage two of the process of the invention until the moisture content in the wood has dropped to the desired value, generally below 16 percent and preferably between 8 and 12 percent. At this point drying is considered complete.

The process described above is based on two fundamental considerations. Firstly, it is necessary to dry beams boards and other pieces of timber through air circulation at moderate temperature, in a manner such as not to produce changes in the fibrous and porous original structure of the wood, which changes take place if the air temperature is too high. However, to complete drying at this safe rate, as with natural seasoning without applying forced circulation, would take too long for economic practicability. It has now been found that it is possible to reach a state of dehydration, at a slow and safe rate, at which the fibrous and porous structure of the timber is sufficiently stable to allow an increase in the drying temperature for the purpose of expediting the final result and obtaining a given degree of dehydration in a time substantially shorter than that which would be required if drying were to be continued under the conditions of the first stage, without, nevertheless, compromising on the stability of the structure of the timber; thus it was found that, in the second stage of the process of this invention the temperature could be increased up to between 34°C and 38°C without deleteriously affecting the stabilisation of the timber attained at the end of the first stage.

The following Table shows by way of example the course of a drying process conducted according to the present invention on a stack of freshly sawn wood, comprising boards of larch, pine and fir.

| Elapsed Time (Hours) | Air temp. | Moisture content of wood | Relative humidity of air |
|---|---|---|---|
| FIRST STAGE | | | |
| 0 | 24 | 80 | 90 |
| 24 | 25 | 55 | 83 |
| 48 | 25 | 46 | 77 |
| 72 | 26 | 35 | 70 |
| 96 | 26 | 27 | 63 |
| 120 | 27 | 22 | 57 |
| 144 | 28 | 19 | 48 |
| 156 | 29 | 17 | 44 |
| SECOND STAGE | | | |
| 168 | 34 | 15 | 40 |
| 180 | 35 | 13 | 37 |
| 204 | 35,5 | 12 | 30 |
| 224 | 36 | 11 | 25 |

As will be seen, the wood was dried to 11% moisture content in 9 days, 8 hours. If, in place of the second stage of the process drying had been continued under the conditions of the first stage, in the same time of 9 days 8 hours the wood would have had a moisture content between 15 and 16 percent by weight: to reduce the humidity to 11 percent would have taken about one week longer.

By way of comparison, a stack of wood entirely similar in composition to the one dealt with in the Table, was subjected to drying at the maximum temperature tabulated, that is, 36°C. After 224 hours of treatment the wood still had a moisture content of 27 percent. Even if this treatment was extended to 30 days it was not possible to reduce the moisture content to 11 percent. At the same time the wood became cracked and distorted. This illustrates how an elevated temperature, applied too rapidly and too soon to green timber, causes occlusion of the pores which hinders migration and evaporation of the moisture from the wood, and also that such a treatment does not have the required "stabilizing" effect.

By way of a further example of the process according to this invention, the chamber 10 was stacked with wood in the form of sawn boards and beams, of both soft woods (Swiss pine, larch, pine, fir) and hard woods (chestnut, oak, cherry and plane). Drying was started after the wood had been brought to 22°C. After 12 days the moisture content of the wood had dropped to 19 percent; the temperature in the chamber 10 at that time was 28.5°C. During the next 24 hours the temperature was brought up to 34°C and drying continued for a further 3 days. After this the stack was cooled gradually for 6 hours down to ambient temperature. Upon inspection it was found that all the pieces of timber in the stack had a moisture content between 10 and 12 percent. No board or beam showed any splits, distortions or warps. The total drying time (including preheating) was 17 days.

It will be appreciated that in the performance of the process of this invention the wood to be dried must be stacked, as is normal practice for kiln drying of wood, so as to facilitate the circulation of air through the stack, and obtain maximum contact of the air with the surfaces of the boards or beams of the stack. As is known, this can be achieved by inserting between one layer of wood and the next several strips of wood of 35 – 40 mm in thickness. If the thickness of the spacer strips is greater than this the circulation of the air through the stack is improved but the arrangement then becomes uneconomical owing to the large volume taken up by the stack with respect to the effective volume of wood contained in it.

I claim:

1. In a process for the forced drying of wood, wherein air is circulated around a closed circuit in which the air is heated, passed over the wood to be dried, de-humidified by cooling and then re-heated to commence another circuit, the improvement comprising the steps of:

a. a first stage of heating and maintaining the air passing over the wood at between 20°C and 30°C until the moisture content of the wood has fallen to between 16 and 25 percent by weight; and b. a second stage of raising the temperature of the air passing over the wood to between 34°C and 38°C and maintaining the air passing over the wood at between 34°C and 38°C until the moisture level of the wood has fallen to a predetermined level at which drying is considered complete.

2. A process as in claim 1, wherein the temperature of the air in the first stage of the process is maintained at between 20°C and 30°C until the moisture content of the wood has fallen to between 18 and 20 percent.

3. A process as in claim 1, wherein the second stage of the process is continued until the moisture content of the wood has fallen to between 8 and 12 percent.

4. A process as in claim 2, wherein the second stage of the process is continued until the moisture content of the wood has fallen to between 8 and 12 percent.

5. A process as in claim 1, wherein the first stage is preceded by a preliminary heat-up stage during which the air is not de-humidified, dehumidification being initiated when the temperature of the air passing over the wood has reached a value of at least 20°C.

6. A process as in claim 1, wherein the first stage amounts to at least about half of the time taken for the whole process.

7. In a process for the forced drying of wood, wherein air is circulated around a closed circuit in which the air is heated, passed over the wood to be dried, de-humidified by cooling and then re-heated to commence another circuit, the improvement comprising the steps of:

a. a first stage of heating and maintaing the air passing over the wood at between 20°C and 30°C for a period of time until the moisture content of the wood has fallen to the point of fibre saturation; and b. a second stage of raising the temperature of the air passing over the wood to above 34°C.

8. A process as in claim 7, wherein the first stage is preceded by a preliminary heat-up stage during which the air is not de-humidified, dehumidification being initiated when the temperature of the air passing over the wood has reached a value of at least 20°C.

9. A process as in claim 7, wherein the first stage amounts to at least about half of the time taken for the whole process.

10. A process as in claim 7, wherein in the second stage, the air temperature is raised to a value between 34°C and 38°C.

* * * * *